US005134033A

United States Patent [19]

Umise et al.

[11] Patent Number: 5,134,033

[45] Date of Patent: Jul. 28, 1992

[54] THERMAL TRANSFER SHEET

[75] Inventors: Shigeki Umise; Taro Suzuki, both of Tokyo, Japan

[73] Assignee: Dai Nippon Insatsu Kabushiki Kaisha, Japan

[21] Appl. No.: 686,252

[22] Filed: Apr. 16, 1991

[30] Foreign Application Priority Data

Apr. 19, 1990 [JP] Japan ..... 2-104300

[51] Int. Cl.[5] ..... B41M 5/26

[52] U.S. Cl. ..... 428/411.1; 428/195; 428/207; 428/484; 428/488.1; 428/488.4; 428/913; 428/914

[58] Field of Search ..... 428/195, 207, 411.1, 428/484, 488.1, 488.4, 913, 914

*Primary Examiner*—Bruce H. Hess
*Assistant Examiner*—Elizabeth Evans
*Attorney, Agent, or Firm*—Ladas & Parry

[57] ABSTRACT

A thermal transfer sheet has a substrate film, a heat-fusible ink layer formed on one surface side of the substrate film, and an antisticking layer formed on the other surface side of the substrate film. The heat-fusible ink layer comprises a carbon black having toluene-coloring transmittance of 60% or more, and, therefore, there is provided a thermal transfer sheet containing a heat-fusible ink layer having an uniform thickness and being capable of providing printed letters improved in blackness and durability such as solvent resistance.

4 Claims, 1 Drawing Sheet

THERMAL TRANSFER SHEET

FIELD OF THE INVENTION AND RELATED ART

The present invention relates to a thermal transfer sheet, and more particularly, to a thermal transfer sheet capable of providing printed letters improved in blackness and durability such as solvent resistance, etc.

Hitherto, in a case where an output from a computer or word processor is printed by a thermal transfer system, there has been used a thermal transfer sheet comprising a substrate film and a heat-fusible ink layer disposed on one surface side thereof.

Such a conventional thermal transfer sheet comprises a substrate film formed of a paper having a thickness of 10 to 20 μm such as capacitor paper and paraffin paper, or formed of a plastic film having a thickness of 3 to 20 μm such as polyester film and cellophane film. The above-mentioned thermal transfer sheet has been prepared by coating the substrate film with a heat-fusible ink composed of a wax and a colorant such as dye or pigment mixed therein, to form a heat-fusible ink layer on the substrate film. Especially, the thermal transfer sheet used in black letter printing has a heat-fusible ink layer composed of a carbon black.

On the other hand, a conventional carbon black has been used as a recording material such as an ink for newpapers, a printing ink, a thermal transfer sheet, a copying toner and a writing ink, a coating material, and a black pigment for colored resin, etc.

Such conventional carbon blacks having many kinds of color tones and particle-sizes are commercially produced by the carbonization of various kinds of hydrocarbon. However, specifically, such each of conventional carbon blacks is insufficient in blackness and solvent resistance in the case of using it as a recording material.

That is, a thermal transfer layer of a conventional black thermal transfer sheet is formed on a substrate film by applying thereonto a liquid of melted ink which includes a carbon black and a vehicle predominantly comprising a wax. However, in the case of using a conventional carbon black, a viscosity of the liquid of melted ink is changeable, so that it is apt to occur an unevenness of the ink layer in coating step and a severe control of coating condition is required.

Further, when the printed letters formed by using the conventional black thermal transfer sheet are exposed to solvent or oil, they are melted to flow out and a transfer-receiving material is contaminated around the letters to become brown.

Furthermore, printed letters formed by using the conventional black thermal transfer sheet tend to have a color of brown black, so that a blue pigment have to be added to the ink layer. However, in that case, the printed letters are insufficient in hue stability.

SUMMARY OF THE INVENTION

An object of the present invention is to solve the above-mentioned problems encountered in the prior art and to provide a thermal transfer sheet containing a heat-fusible ink layer having an uniform thickness and being capable of providing printed letters improved in blackness and durability such as solvent resistance.

According to an aspect of the present invention, there is provided a thermal transfer sheet comprising a substrate film, a heat-fusible ink layer formed on one surface side of a substrate film, and an antisticking layer formed on another surface side of the substrate film, said heat-fusible ink layer containing a carbon black having toluene-coloring transmittance of 60% or more.

According to the above-mentioned an aspect of the present invention, there is provided a thermal transfer sheet containing a heat-fusible ink layer having an uniform thickness and being capable of providing printed letters improved in blackness and durability such as solvent resistance.

Further, objects, features and other aspects of this invention will be understood from the following detailed description of the preferred embodiments of this invention with reference to the drawings.

DETAILED DESCRIPTION OF THE PREFERRED EMBODIMENTS

Figure 1:
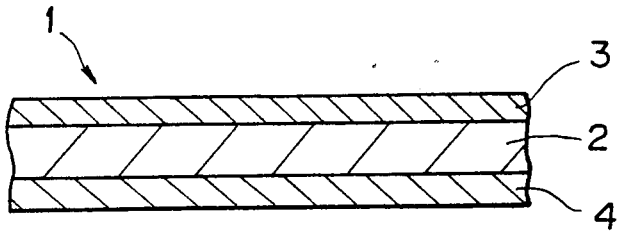
FIG. 1 is a schematic sectional view showing an embodiment of a thermal transfer sheet according to the present invention.

FIG. 1 is a schematic sectional view showing an embodiment of a thermal transfer sheet according to the present invention. Referring to FIG. 1, the thermal transfer sheet 1 comprises a substrate film 2, a heat-fusible ink layer 3 formed on one surface side of the substrate film 2, and an antisticking layer 4 formed on the other surface side of the substrate film 2.

The substrate film 2 to be used in the present invention may be one selected from those used in the conventional thermal transfer sheet. However, the above-mentioned substrate film 2 is not restricted thereto and any of other films can be used.

Preferred examples of the substrate film 2 may include: plastic films such as those comprising polyester, polypropylene, cellophane, polycarbonate, cellulose acetate, polyethylene, polyvinyl chloride, polystyrene, nylon, polyimide, polyvinylidene chloride, polyvinyl alcohol, fluorine-containing resin, chlorinated rubber, and ionomer resin; papers such as capacitor paper and paraffin paper; non-woven fabric; etc. The substrate film 2 can also comprise a composite or laminate of the above-mentioned films.

The substrate film 2 may preferably have a thickness of 2 to 25 μm, while the thickness can appropriately be changed correspondingly to the materials thereof so as to provide suitable strength and heat conductivity.

The heat-fusible ink layer 3 formed on one surface side of the above-mentioned substrate film 2 comprises carbon black, vehicle and optional additive.

The carbon black can be used in the present invention has impurities having a solubility to toluene less than a specified content.

That is, a conventional carbon black includes many kinds of hydro-carbons formed in production step which comprises a carbonization of various kinds of hydrocarbons. According to our detailed investigations, it has been found that the impurities having the solubility to toluene cause the above-mentioned problems encountered in the prior art.

Specific examples of the above-mentioned impurities having the solubility in toluene may include; pyrene, fluoranthene, 3,4-benzpyrene, 1,2-benzpyrene, anthanthrene, benzperylene, coronene, polycyclic aromatic hydrocarbon, or oxygen-compound thereof including carboxyl group, hydroxyl group, and quinone group.

The carbon black can be used in the present invention has a low content of the above-mentioned impurities, and, therefore, has a toluene-coloring transmittance of 60% or more. The toluene coloring transmittance may be measured by the manner mentioned hereinafter.

Measurement of Toluene-Coloring Transmittance (%)

The toluene-coloring transmittance can be measured in the same manner as JIS (Japanese Industrial Standard) K 6 221- 1970 - 5, 4 (measurement of benzene-coloring transmittance) except that benzene is replaced with toluene and a measuring light having a wave length of 420±5 nm is replaced with one having a wave length of 335±5 nm.

That is, a dried sample of carbon black having a weight of 5.0±0.1 g and a toluene of 50 ml are put into an erlenmeyer flask provided in JIS R 3503 instrument, and kept in a gently boiling condition for 20 seconds. Then, the content of the erlenmeyer flask is immediately filtered through a filter paper and the resultant filtrate is put into an absorption cell so as to measure a toluene-coloring transmittance at a wave length of 335±5 nm. The measurement may be indicated by percentages (%).

The above-mentioned wave length (335±5 nm) of the measuring light is selected on the basis of the reason that 3,4-benzpyrene can be accurately measured in volume by using the measuring light having the above-mentioned wave length, and an absorption band of a mixture of the above-mentioned impurities exist in a range of wave length of 200 nm to 350 nm.

The carbon black can be used in the present invention may be obtained by using a wash-treatment wherein the conventional carbon black is washed with an organic solvent such as toluene, xylene, benzene, etc., or by using a heat-treatment wherein the conventional carbon black is heated in atmospheric air for 1 to 60 minutes at 150° to 350° C. so as to evaporate the impurities as the degradation products therefrom.

The concentration of the carbon black in the heat-fusible ink layer 3 may preferably be in the range of 5 to 50 wt. %.

The vehicle to be used for forming the heat-fusible ink layer 3 may predominantly comprise a wax or a mixture of a wax and another component such as drying oil, resin, mineral oil, and derivatives of cellulose and rubber.

Representative examples of the wax may include microcrystalline wax, carnauba wax, paraffin wax, etc. In addition, specific examples of the wax may include: various species thereof such as Fischer-tropsch wax, various low-molecular weight polyethylenes, Japan wax, beeswax, whale wax, insect wax, lanolin, shellac wax, candelilla wax, petrolactam, partially modified wax, fatty acid ester, and fatty acid amide.

In the present invention, it is possible to mix a thermoplastic resin having a relative low softening point into the above-mentioned wax so as to enhance the adhesion property of the heat-fusible ink layer to a transfer-receiving material.

Specific examples of the thermoplastic resin may include; ethylene-vinylacetate copolymer (EVA), ethylene-acrylic ester copolymer (EEA), ethylene-acrylic acid copolymer (EAA), ionomer resin, polyethylene, polystyrene, polypropylene, polybutene, petroleum resin, vinyl chloride, vinyl chloride-vinyl acetate copolymer, polyvinyl alcohol, vinylidene chloride, methacrylic resin, polyamide, polyester, polyether, polycarbonate, fluorocarbon resin, polyvinylformal, polyvinyl butyral, acetyl cellulose, nitrocellulose, polyvinyl acetate, polyisobutylene, ethyl cellulose, polyacetal, etc. Among these, the thermoplastic resin which can be use as a heat-sensitive adhesive having a softening point of 50° to 80° C. is particularly perferred. It is preferred to use the thermoplastic resin in an amount of 5 to 300 wt. parts per 100 wt. parts of the wax.

In order to directly or indirectly form a heat-fusible transferable ink layer 3 on the substrate film 2, there may be used a method such as hot-melt coating, hot-lacquer coating, gravure coating, gravure reverse coating and roller coating. The thickness of the ink layer 3 may preferably be 0.5 to 5 μm in the case of using the thermal transfer sheet 1 for one time use, and may preferably be 5 to 15 μm in the case of using the thermal transfer sheet 1 for multiple use or an n-fold (n: natural number) recording.

The antisticking layer 4 formed on the other surface side of the above-mentioned substrate film 2 comprises a heat resistance resin and a material such as a lubricant or a heat mold release agent.

Specific examples of the heat resistance resin may include; a synthetic resin having a glass transition point of at least 60° C.; a compound of a thermoplastic resin having an OH group or COOH group and containing at least two amino groups; and a substrate prepared by crosslinked reaction by adding a di-isocyanate or a tri-isocyanate to the compound, etc.

Further, specific examples of the heat resistance resin may include: cellulose resins such as ethylcellulose, hydroxyethyl cellulose, ethyl-hydroxy-ethylcellulose, hydroxypropyl cellulose, methylcellulose, cellulose acetate, cellulose acetate butyrate, and nitrocellulose; vinyl-type resins such as polyvinyl alcohol, polyvinyl accetate, polyvinyl butyral, polyvinyl acetal, polyvinyl pyrrolidone, acrylic resin, polyacrylamide, and acrylonitrile-styrene copolymer; polyester resin, polyurethane resin, silicone-modified or fluorine-modified urethane resin, etc. Among these, it is preferred to use a resin having a little reactivity (e.g., one having hydroxyl group, carboxyl group, or epoxy group) in combination with a crosslinking agent such as polyisocyanate so as to provide a crosslinked resin layer.

Specific examples of such a lubricant or a heat mold release agent may include; a material such as wax, higher fatty acid amide, higher fatty acid ester, higher fatty acid salt, etc., which achieve their own function under a melting condition; and a material such as a fluorocarbon resin, a particle of an inorganic material, etc., which achieve their own function under a solid condition.

Further, the heat resistance resin constituting the antisticking layer 4 may predominantly comprise a styrene-acrylonitrile copolymer.

Among styrene-acrylonitrile copolymers of various grades, it is preferred to use one having a molecular weight of $10\times10^4$ (more preferably $15\times10^4$ to $19\times10^4$), and/or an acrylonitrile content of 20 to 40 mol % (more preferably 25 to 30 mol %). Such a copolymer may preferably have a softening temperature of 400° C. or higher according to differential thermal analysis, in view of heat resistance and dissolution stability to an organic solvent.

Further, it is possible to use a small amount of such as adhesive resin in combination with the above-mentioned binder.

The adhesive resin may preferably comprise an amorphous linear saturated polyester resin having a glass transition point of 50° C. or higher.

Further antisticking layer 4 may comprise a heat resistance resin as described above, and at least two species of heat-resistant particles having different particle sizes.

Further, the antisticking layer 4 may comprise a heat resistance resin as described above, and a lubricating agent (or lubricant) comprises an alkylphosphate (or alkylphosphoric acid ester) multi-valent metal salt.

Preferred examples of the alkylphosphate multivalent metal salt may include those represented by the following formula:

$$[(RO)_2P-\overset{\overset{\displaystyle O}{\|}}{C}-O-]nM, \text{ and/or}$$

$$[(RO)P=(O-)_2]n/2\ M,$$

wherein R denotes an alkyl group having 12 or more carbon atoms such as cetyl, lauryl, and stearyl (particularly, stearyl); M denotes an alkaline earth metal such as barium, calcium, and magnesium, and zinc, aluminum, etc.; and n denotes the valance of M.

The above-mentioned antisticking layer 4 can prevent a substrate film having an insufficient heat-resistance from sticking. Therefore, the properties of an anticut-off and a easy-processing of the plastic film to be used for the substrate film 2 can be utilized.

Figure 2:
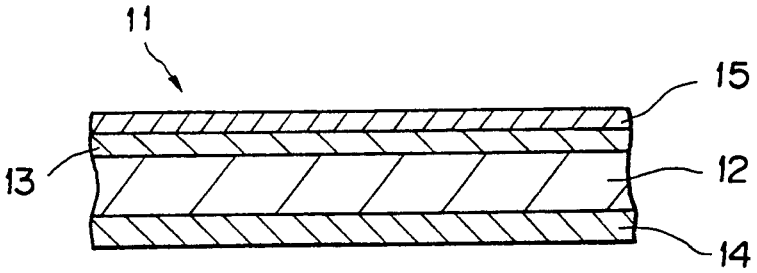
FIG. 2 is a schematic sectional view showing another embodiment of the thermal transfer sheet according to the present invention.

Referring to FIG. 2, the thermal transfer sheet 11 according to the present invention may also comprise a substrate film 12, a heat-fusible ink layer 13 and a surface layer 15 formed on one surface side of the substrate film 12, and an antisticking layer 14 formed on the other surface side of the substrate film 12.

The surface layer 15 is formed of the wax described above and prevents a ground staining of a transfer-receiving paper.

The surface layer 15 may comprise a wax which is the same as that used in the above-mentioned heat-fusible transferable ink layer 3.

The surface layer 15 may be formed by using various techniques in the same manner as in the formation of the ink layer. The surface layer 15 may be selected so that the sensitivity does not become insufficient even in the case of a high-speed type printer using a low printing energy. In the present invention, the surface layer 15 may perferably have a thickness which is not smaller than 0.1 μm and smaller than 5 μm. If the thickness is too small, a problem such ground staining occurs.

The surface layer of transferred (printed) letters may perferably be substantially colorless. Further, the surface layer 15 can be colored white by addition of an appropriate amount of extender pigment to the surface layer 15.

EXPERIMENTAL EXAMPLE

Hereinbelow, the thermal transfer sheet according to the present invention is described in more detail with reference to experimental Examples. In the description appearing hereinafter, "part(s)" and "%" are "part(s) by weight" and "% by weight", respectively, unless otherwise noted specifically.

EXAMPLE 1

First, the following composition was mixed under stirring and subjected to dispersion treatment for three hours by means of a paint shaker, and an appropriate amount of a diluting solvent (MEK/toluene = 1/1) was added to the resultant mixture thereby to prepare an ink for an antisticking layer.

| Ink composition for antisticking layer | |
|---|---|
| Styrene-acrylonitrile copolymer (Sebian AD, mfd. by Daiseru Kagaku K.K.) | 95 parts |
| Linear saturated polyester resin (Eriter UE 3200, mfd. by Unitika K.K.) | 5 parts |
| Zinc stearyl phosphate (LBT 1830, mfd. by Sakai Kagaku K.K.) | 10 parts |
| Solvent (MEK/toluene = 1/1) | 400 parts |

The above-mentioned ink was applied onto one surface side of a 6 μm-thick polyester film (Lumirror F-53, mfd. by Toray K.K.) by means of a wire bar coater so as to provide coating amounts of 0.5 g/m$^2$ (based on solid content), and then dried by using hot air, whereby a substrate film having the antisticking layer was obtained.

A carbon black (MA7, mfd. by Mitsubishi Kasei K.K.) of 100 parts was added to toluene of 2000 parts, and the mixture was vigorously stirred for 3 hours at 60° C. The resultant mixture was then filtered through a filter paper and the residue was washed with toluene and dried at a room temperature. The toluene-coloring transmittance of the prepared carbon black was 85%.

Thereafter, the following ink composition including the above-mentioned carbon black was mixed for 6 hours at 120 ° C.

| Ink compositin for heat-fusible layer | |
|---|---|
| Carbon black (above-mentioned) | 15 parts |
| Ethylene-vinyl acetate copolymer (EVA Flex 310, mfd. by Mitsui Polychemical K.K.) | 8 parts |
| Paraffin wax (Paraffin 150F, mfd. by Nippon Sairo K.K.) | 50 parts |
| Carnauba wax | 25 parts |

The above ink composition was heated at 120° C. and applied onto the surface of the above-mentioned substrate film having an antisticking layer on the back surface thereof by means of a hot-melt roll coating method so as to provide a coating amount (after drying) of about 3 g/m$^2$, to form a heat-fusible ink layer, whereby a thermal transfer sheet (Sample 1) according to the present invention was obtained.

EXAMPLE 2

A thermal transfer sheet (Sample 2) according to the present invention was prepared in the same manner as in Example 1 except that a heat-fusible ink layer was formed by using a carbon black obtained by the following manner.

A carbon black (MA8, mfd. by Mitsubishi Kasei K.K.) of 100 parts was added to xylene of 2000 parts, and the mixture was vigorously stirred for 2 hours at 80° C. And then, the resultant mixture was filtered through a filter paper and the residue was washed with xylene and dried at a room temperature. The toluene-coloring transmittance of the prepared carbon black was 70%.

EXAMPLE 3

A thermal transfer sheet (Sample 3) according to the present invention was prepared in the same manner as in Example 1 except that a heat-fusible ink layer was formed by using a carbon black obtained as the following manner.

A carbon black (Seast SO, mfd. by Tokai Carbon K.K.) of 100 parts was added to a solvent (MEK/-toluene = 1/1) of 1000 parts, and the mixture was vigorously stirred for 2 hours at 30° C. The resultant mixture was then filtered through a filter paper and the residue was washed with methanol and dried at a room temperature. The toluene-coloring transmittance of the prepared carbon black was 63%.

EXAMPLE 4

A thermal transfer sheet (Sample 4) according to the present invention was prepared in the same manner as in Example 1 except that a heat-fusible ink layer was formed by using a carbon black obtained by the following manner.

A carbon black (MA7, mfd. by Mitsubishi Kasei K.K.) was heated in atmospheric air for 30 minutes at 300° C. by means of an electric drier. The resultant carbon black was then cooled to a room temperature. The toluene-coloring transmittance of the prepared carbon black was 80%.

EXAMPLE 5

A thermal transfer sheet (Sample 5) according to the present invention was prepared in the same manner as in Example 1 except that a heat-fusible ink layer was formed by using a carbon black obtained in the following manner.

A carbon black (MA7, mfd. by Mitsubishi Kasei K.K.) at 200° C. by means of an electric drier. The resultant carbon black was then cooled to a room temperature. The toluene-coloring transmittance of the prepared carbon black was 70%.

COMPARATIVE EXAMPLE 1

A thermal transfer sheet (Comparative Sample 1) was prepared in the same manner as in Example 1 except that the original carbon black (MA7, Toluene-coloring transmittance = 40%) was used.

COMPARATIVE EXAMPLE 2

A thermal transfer sheet (Comparative Sample 2) was prepared in the same manner as in Example 2 except that the original carbon black (MA8, Toluene-coloring transmittance = 10%) was used.

COMPARATIVE EXAMPLE 3

A thermal transfer sheet (Comparative Sample 3) was prepared in the same manner as in Example 3 except that the original carbon black (Seast SO, Toluene-coloring transmittance = 4%) was used.

Each of Samples 1 to 3 and Comparative Samples 1 to 3 as prepared in the above described manners, was loaded on a thermal printer and subjected to printing so as to provide printed letters under the following conditions and to evaluate a printing quality and a solvent resistance of the printed letters based on the following evaluation levels.

The thus obtained results were compared with each other as shown in the following Table 1.

Printing Conditions

Printer: Line type printer provided with a thin-film thermal head (10 dot/mm)
Printing energy: 0.4 mJ/dot (constant)
Transfer receiving material: Plain paper

TABLE 1

| | Printing Quality | Solvent Resistance |
|---|---|---|
| Sample 1 | ◎ | ◎ |
| Sample 2 | ◎ | ◎ |
| Sample 3 | ◎ | ◎ |
| Sample 4 | ◎ | ◎ |
| Sample 5 | ◎ | ◎ |
| Comparative Sample 1 | ○ | Δ |
| Comparative Sample 2 | ○ | Δ |
| Comparative Sample 3 | ○ | Δ |

Evaluation Levels

Printing Quality: Evaluation with the naked eye
◎ : Excellent in blackness
○ : Black tinged with brown
Solvent resistance: A drop of toluene was added dropwise to the printed letters.
◎ : Non coloration happened around the printed letters
Δ : Coloration to brown happened around the printed letters.

What is claimed is:

1. A thermal transfer sheet comprising a substrate film, a heat-fusible ink layer formed on one surface side of the substrate film, and an antisticking layer formed on another other surface side of the substrate film, said heat-fusible ink layer containing a carbon black having toluene-coloring transmittance of 60% or more.

2. A thermal transfer sheet according to claim 1, wherein the toluene-coloring transmittance is measured by using a light having a wave length of 335±5 nm.

3. A thermal transfer sheet according to claim 1, wherein the heat-fusible ink layer further contains a thermoplastic resin having a softening point of 50° to 80° C.

4. A thermal transfer sheet according to claim 1, which further comprises a surface layer formed on the heat-fusible ink layer.

* * * * *